US008122675B2

(12) United States Patent
Ripley et al.

(10) Patent No.: US 8,122,675 B2
(45) Date of Patent: Feb. 28, 2012

(54) REBAR POSITIONER

(75) Inventors: Mike Ripley, Charlotte, NC (US); Theodore A. Erickson, Gastonia, NC (US); Ralph O. Johnson, III, Charlotte, NC (US)

(73) Assignee: Masonry Reinforcing Corporation of America, Charlotte, NC (US)

( * ) Notice: Subject to any disclaimer, the term of this patent is extended or adjusted under 35 U.S.C. 154(b) by 4 days.

(21) Appl. No.: 12/843,447

(22) Filed: Jul. 26, 2010

(65) Prior Publication Data

US 2010/0281814 A1 Nov. 11, 2010

Related U.S. Application Data

(63) Continuation-in-part of application No. 11/940,744, filed on Nov. 15, 2007, now abandoned.

(60) Provisional application No. 60/865,927, filed on Nov. 15, 2006.

(51) Int. Cl.
*E04C 5/16* (2006.01)

(52) U.S. Cl. ..... 52/687; 52/712; 248/302

(58) Field of Classification Search ..... 52/677, 52/687, 686, 431, 699, 712; 248/249, 302
See application file for complete search history.

(56) References Cited

U.S. PATENT DOCUMENTS

| | | | | | |
|---|---|---|---|---|---|
| 1,574,326 | A * | 2/1926 | White | 52/687 |
| 1,616,977 | A * | 2/1927 | Koivu | 52/426 |
| 1,673,431 | A * | 6/1928 | Voight | 52/681 |
| 2,714,817 | A * | 8/1955 | Griffiths | 52/688 |
| 3,145,505 | A * | 8/1964 | Cornelius | 52/712 |
| 3,172,239 | A * | 3/1965 | Larkin | 52/677 |
| 4,107,895 | A * | 8/1978 | LeGrady | 52/687 |
| 4,190,999 | A * | 3/1980 | Hampton | 52/687 |
| 4,337,605 | A * | 7/1982 | Tudek | 52/293.2 |
| 5,704,188 | A * | 1/1998 | Coulis | 52/834 |
| 5,832,690 | A * | 11/1998 | Kaines | 52/677 |
| 6,240,688 | B1 * | 6/2001 | Dressler | 52/295 |
| 6,421,977 | B2 * | 7/2002 | Timperman et al. | 52/714 |
| 7,243,897 | B2 * | 7/2007 | Huber et al. | 249/34 |
| 7,467,777 | B2 * | 12/2008 | Huber et al. | 249/214 |
| 2007/0039278 | A1 * | 2/2007 | Crowell | 52/677 |
| 2007/0157541 | A1 * | 7/2007 | Mossbeck et al. | 52/677 |

* cited by examiner

*Primary Examiner* — Robert Canfield
*Assistant Examiner* — Brent W Herring
(74) *Attorney, Agent, or Firm* — Shumaker, Loop & Kendrick, LLP

(57) ABSTRACT

A rebar positioner configured for being placed in a diagonal orientation within a cell of a masonry block including first and second end sections oriented in a first plane, a center S-shaped section in a second plane parallel to the first, laterally offset linear sections oriented in the second plane, and first and second vertical sections interconnecting the first and second end sections with the first and second linear sections, wherein the second end section terminates in a telltale extending away from the center section.

9 Claims, 20 Drawing Sheets

REBAR POSITIONER

CROSS-REFERENCE TO RELATED APPLICATION

This application is a continuation-in-part patent application claiming priority to U.S. patent application Ser. No. 11/940,744 filed Nov. 15, 2007 and entitled "REBAR POSITIONER", which claims priority to U.S. Provisional Patent Application No. 60/865,927 filed Nov. 15, 2006, the contents of both of which are incorporated by reference herein.

TECHNICAL FIELD AND BACKGROUND OF THE INVENTION

1. Field of the Invention

The present invention relates generally to the field of reinforcing bar positioners, and more particularly, to a rebar positioner including a center section having an S-shape oriented in a first plane and interconencting first and second end sections in a second, parallel plane for being supported upon the block surface, the second end section defining a telltale oriented away from the center section such that improper placement in the cell of the block results in the telltale protruding laterally beyond the side of the block, and thus providing a visual and physical indication of improper installation.

2. Description of the Related Art

It is common in masonry block construction to utilize an elongate steel reinforcing bar, also known as a reinforcement bar or "rebar", positioned vertically within the cell or core of a concrete block or other masonry block unit to provide added strength and stability to the masonry structure. Generally, it is desirable to have the rebar positioned at or proximate the center of the block core to maximize the stabilizing effect of the rebar. As such, a positioner is often used to maintain the rebar at the desired position within the block core while grout, concrete or other hardening fill material is poured into the block core.

Prior art rebar positioners typically include brackets with an enclosed or nearly enclosed area within which the rebar is positioned, and opposing members that extend perpendicularly over the block core onto the top surface of the block. These prior art rebar positioners are constructed such that they lie entirely in one plane, and as such they extend over the top of the core block. Therefore, positioners must rely on the next masonry block being positioned on top of it to maintain its proper position, and the positioners are easily disturbed by movement of the overlying block. The perpendicular arrangement of the positioners contributes to their susceptibility to falling out of position. If the rebars are not maintained in their proper position, the strength and stability of the masonry structure is compromised.

To overcome the disadvantages of the prior art positioner designs, a reinforcing bar positioner is provided herein including a continuous length of wire bent to provide a geometry that advantageously spans the corresponding diagonal length of the core of the block, seats only end portions of the positioner in the plane of the surface of the block, positions the looped rebar maintaining portions down within the core, and includes a telltale for indicating proper installation of the positioner within the core to ensure alignment of the rebar along the longitudinal axis of the block.

BRIEF SUMMARY OF THE INVENTION

Therefore, it is an object of the invention to provide a tool for properly positioning rebar within a core of a masonry block.

It is another object of the invention to provide a rebar positioner that locks in diagonal orientation within the core of the masonry block to prevent shifting of the positioner upon instllation of an overlying block.

It is another object of the invention to provide a multi-planar rebar positioner including a telltale that indicates proper installation within the core of a block to ensure proper alignment of the rebar along the longitudinal axis of the block.

These and other objects of the invention are achieved in the embodiments of the invention described herein. In one embodiment, a rebar positioner configured for being placed in a diagonal orientation within a cell of a masonry block is provided herein and includes a single, continuous wire bent to define first and second end sections oriented coplanar in a first plane, a center section having a general S-shape oriented in a second plane parallel to the first plane, laterally offset first and second linear sections extending in opposing directions from the center section and oriented in the second plane, and first and second connecting sections interconnecting the first and second end sections with the first and second linear sections, respectively, and oriented parallel to each other and perpendicular to the first and second planes, and wherein the second end section terminates in a linear telltale extending away from the center section.

According to a further embodiment, the linear telltale is oriented at an acute angle with respect to the second linear section.

According to a further embodiment, the first end section terminates in a first linear portion oriented at an acute angle toward and with respect to the first linear section.

According to a further embodiment, the linear telltale is oriented at about a 30 degree angle relative to the second linear section.

According to a further embodiment, opposing loops of the center section define centers laterally offset with respect to a centerline of the positioner.

According to a further embodiment, the rebar positioner is positioned within the cell such that the first and second end sections do not extend laterally beyond sides of the block and the telltale extends over a portion of an adjacent cell of the masonry block.

In accordance with another embodiment of the invention, a method of installing a rebar positioner within a cell of a concrete block is provided herein including the steps of: (i) providing a concrete block having sides, an opposing top and bottom, and a cell open to the opposing top and bottom; (ii) providing a rebar positioner comprising a single, continuous wire bent to define first and second end sections oriented coplanar in a first plane, a center section having a general S-shape oriented in a second plane parallel to the first plane, laterally offset first and second linear sections extending in opposing directions from the center section and oriented in the second plane, and first and second connecting sections interconnecting the first and second end sections with the first and second linear sections, respectively, and oriented parallel to each other and perpendicular to the first and second planes, wherein the second end section terminates in a linear telltale extending away from the center section; and (iii) positioning the rebar positioner diagonally within the cell and spanning a distance between opposing corners thereof such that the center section and laterally offset first and second linear sections are positioned within an interior of the cell spaced-apart from the opposing top and bottom, and with the first and second ends seated on the top of the block and not extending laterally beyond the sides of the block.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

Figure 1:
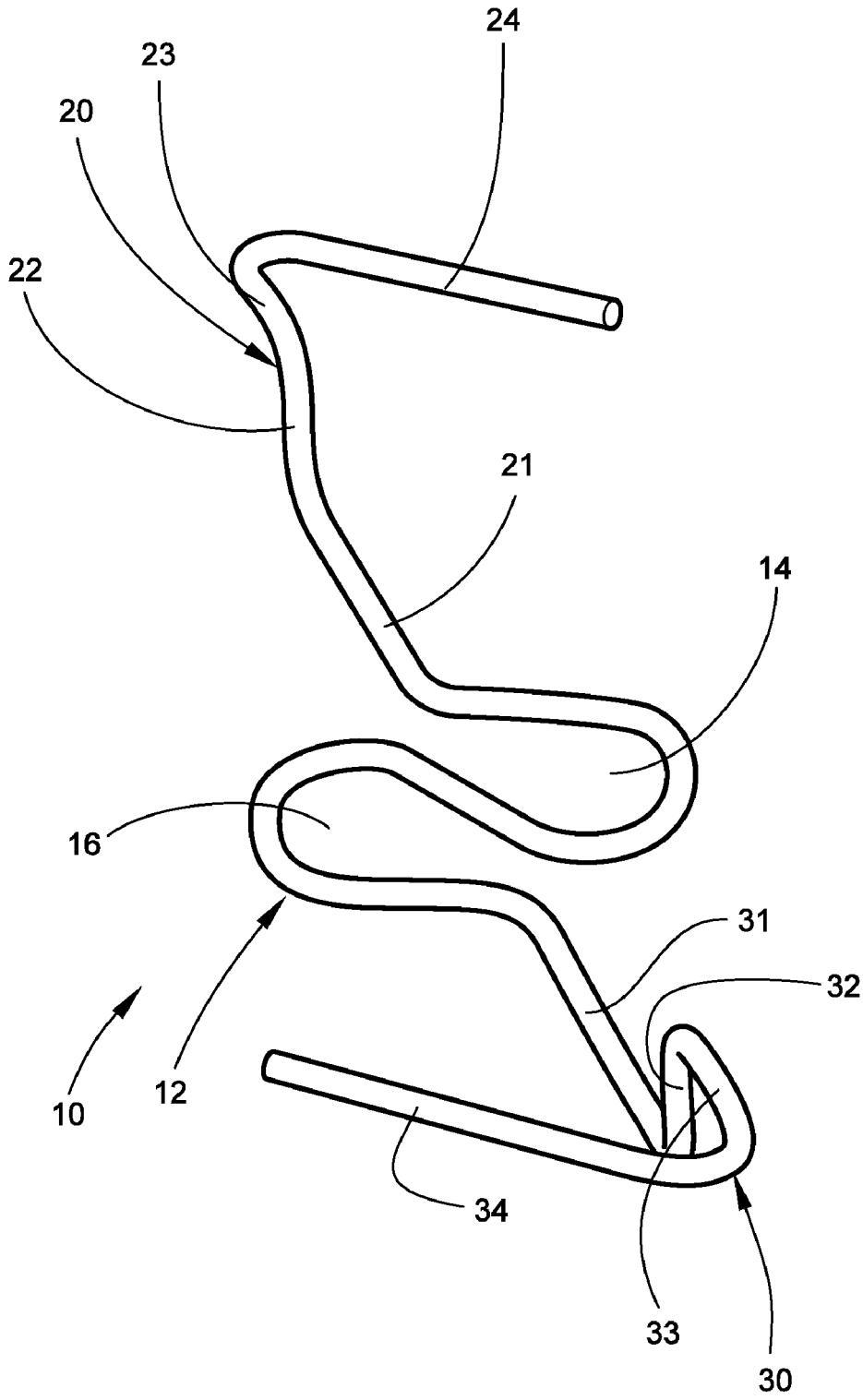
FIG. 1 is a perspective view of a rebar positioner according to a preferred embodiment of the invention.

A rebar positioner according to a preferred embodiment of the invention is illustrated in FIGS. 1-5, and shown generally at reference numeral 10. The rebar positioner 10 comprises a center section 12 having a generally reverse "S" shape that defines two rebar positioning areas 14, 16. Each end of the reverse "S" shaped center section 12 leads to two arms 20, 30 on opposite sides of the center section 12.

The arms 20, 30 have substantially straight first segments 21, 31, respectively, that extend in substantially opposite directions from the center section 12. The first segments 21, 31 are substantially co-linear with each other and lie on substantially the same plane as the center section 12. The first segments 21, 31 lead to an outer section that includes second segments 22, 32, respectively, that extend substantially upwardly from the first segments 21, 31, respectively. The second segments 22, 32 are substantially perpendicular to the first segments 21, 31. Top ends of the second segments 22, 32 lead to third segments 23, 33, respectively, that are substantially perpendicular to the second segments 22, 32, and extend in opposite directions away from the center section 12. Fourth segments 24, 34 extend from the third segments 23, 33, respectively, at acute angles, such as at forty-five degrees. As shown in FIG. 1, the fourth segments 24, 34 extend in opposite directions relative to center axis of the positioner 10. That is, for example, one of the fourth segments 24 extends to the right of the first, second and third segments 21, 22, 23, 31, 32, 33, while the other fourth segment 34 extends to the left of the first, second and third segments 21, 22, 23, 31, 32, 33. Alternatively, the orientation could be reversed with one fourth segment 24 extending to the left of the first, second and third segments 21, 22, 23, 31, 32, 33, while the other fourth segment 34 extends to the right.

Preferably, the positioner 10 is made of a single metal wire having a round cross section. Alternatively, the positioner 10 can be made of other suitable materials, and can be constructed by attaching separate components by welding or other suitable attachment method.

Figure 2:
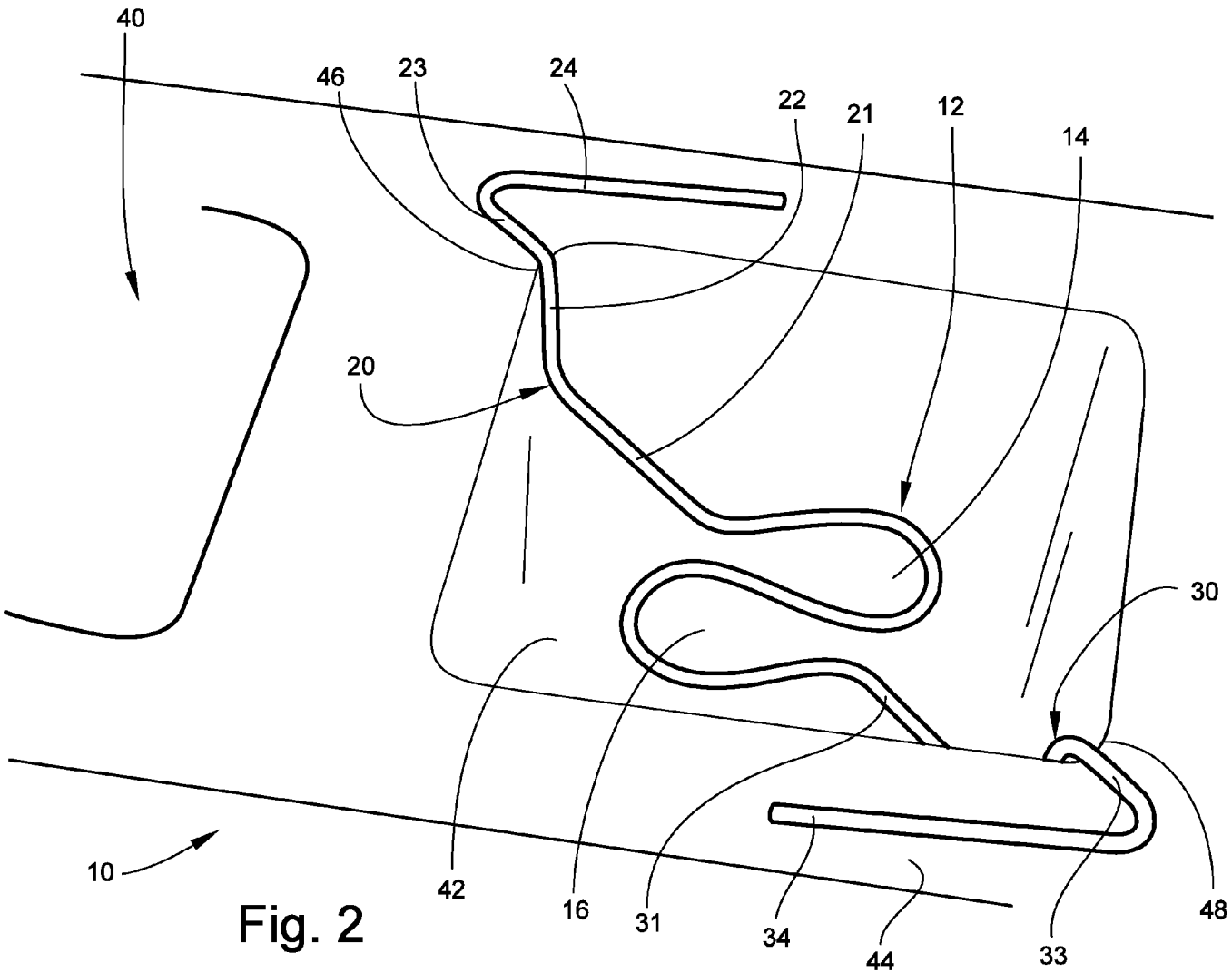
FIG. 2 is an environmental perspective view of the rebar positioner of FIG. 1, shown positioned within the core of a masonry block.

As shown in FIG. 2, the positioner 10 is positioned within a substantially square core 42 of a rectangular masonry block 40. The masonry block 40 can be made of concrete, brick, stone or other suitable masonry material. The positioner 10 is positioned on the masonry block 40 with the third segments 23, 33 and fourth segments 24, 34 lying on the top surface 44 of the block 40. The positioner 10 is positioned within the block core 42 diagonally, such that the second and third segments 22, 23 of one arm 20 are positioned at one corner 46 of the block core 42, while the second and third segments 32, 33 of the other arm 30 are positioned at an opposite diagonal corner 48 of the block core 42. As such, the corners 46, 48 restrict movement of the arms 20, 30, and prevent the positioner 10 from sliding from the desired position. In addition, the opposed arrangement of the fourth segments 24, 34 of the arms 20, 30 further contributes to the stability of the positioner. Furthermore, the counter balanced arrangement of the two loops of the center section 12 also aids in maintaining the positioner 10 in its desired position.

Because the second segments 22, 32 of the arms 20, 30 extend substantially perpendicularly from the first segments 21, 31, the center section 12 resides in a plane below that of the third segments 23, 33 and fourth segments 24, 34, which lie on top of the block 40. As such, the center section 12 resides below the top surface 44 of the block 40 and inside the block core 42, as shown in FIG. 2. In an alternative embodiment, the center section 12 and the arms 20, 30 are generally co-planar, and as such, the entire positioner resides in the same plane on the top surface 44 of the masonry block unit 40.

Figure 3:
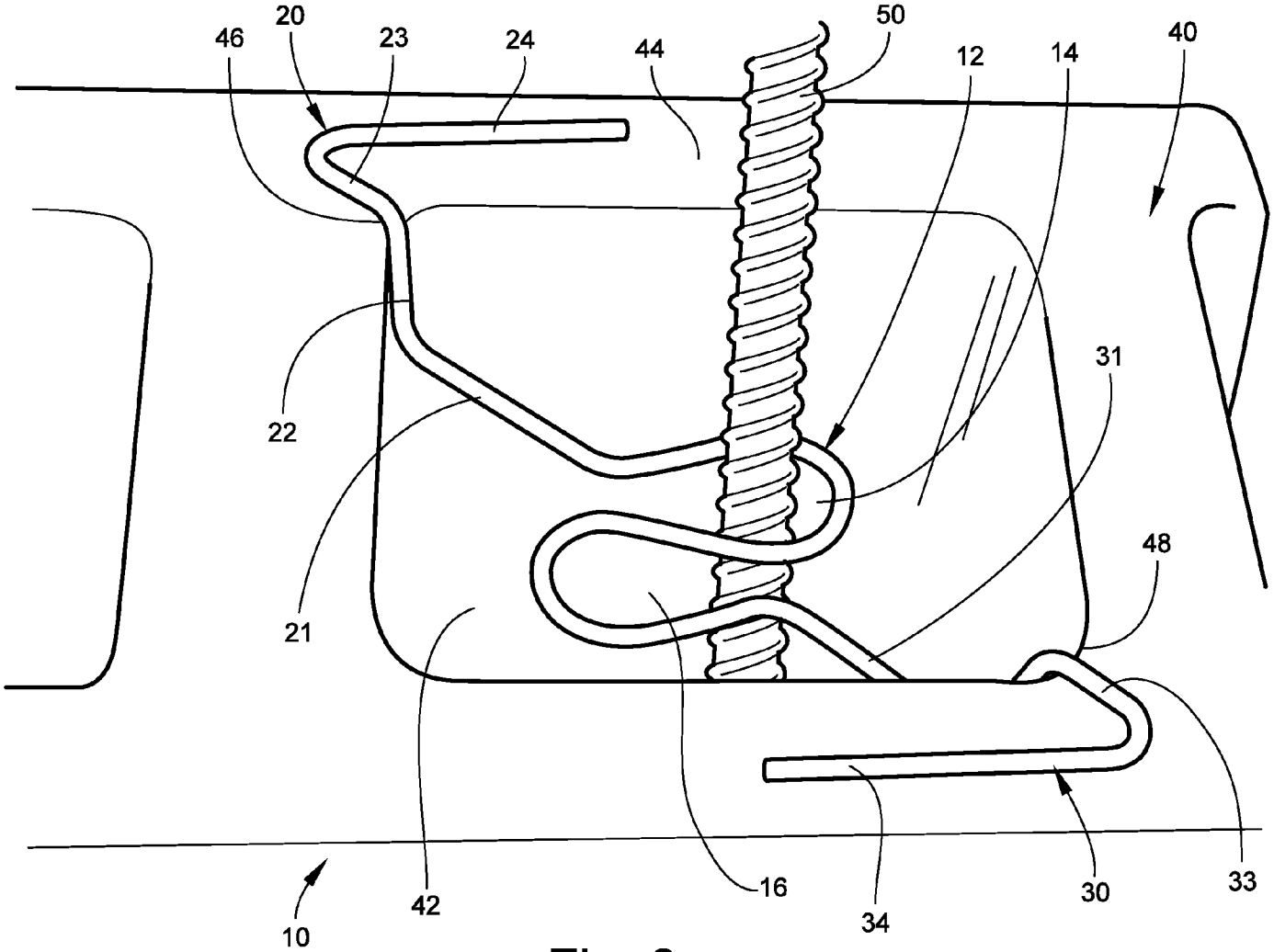
FIG. 3 is an environmental perspective view of the rebar positioner of FIG. 1, shown being used in conjunction with a rebar.
Figure 4:
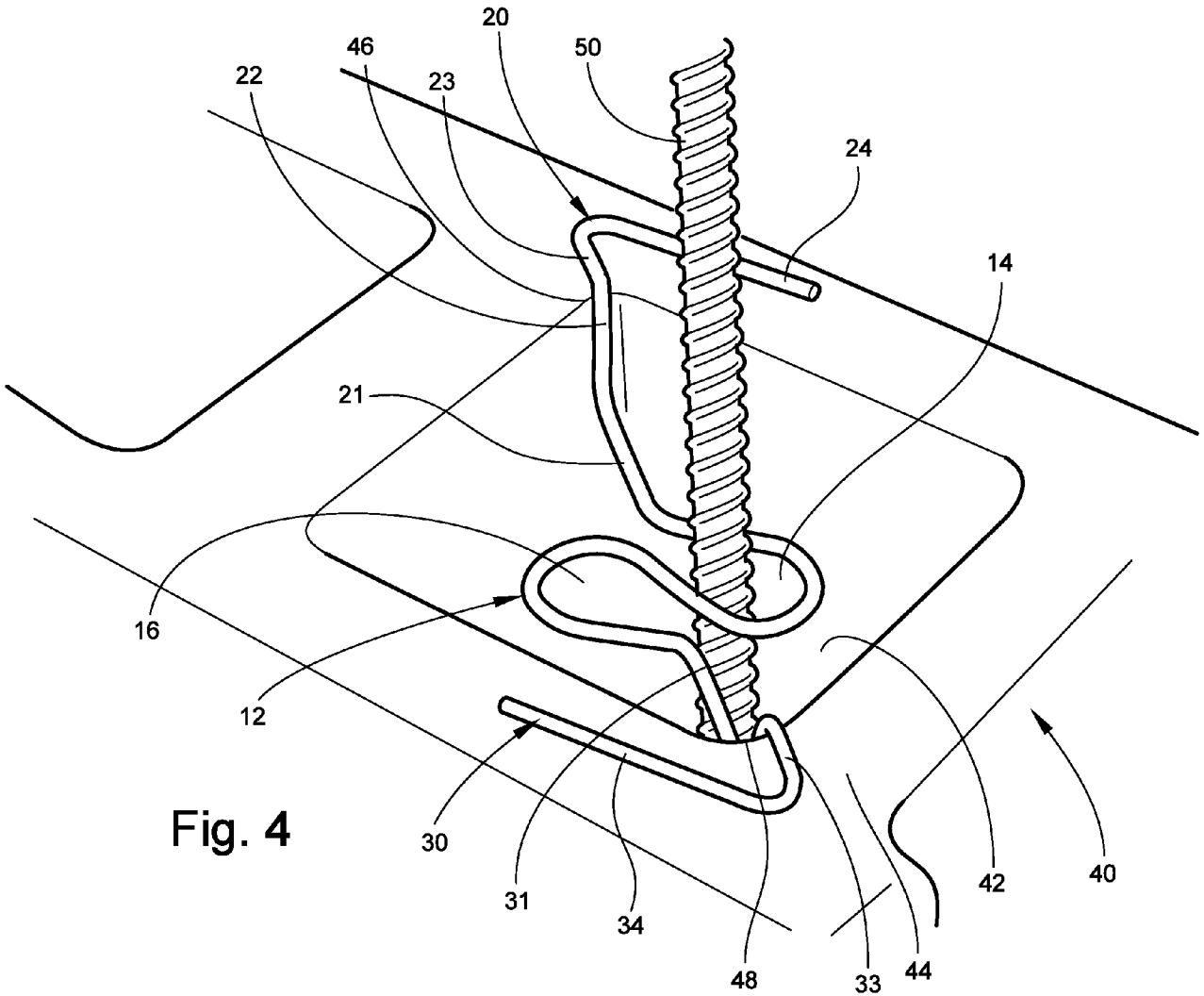
FIG. 4 is another environmental perspective view of the rebar positioner of FIG. 1.

As shown in FIGS. 3 and 4, a reinforcing bar 50, such as of the type generally used in masonry construction and commonly known as a "rebar", can be positioned within a rebar positioning area 14 of the center section 12 to maintain the rebar 50 at a approximately the center of the block core 42 while grout, concrete or other desired hardening fill material is poured into the block core 42. Maintaining the rebar 50 at approximately the center of the block core 42 maximizes the strength and stability provided by the rebar 50 to the masonry structure. Alternatively, the rebar 50 can be positioned within the other rebar positioner area 16 of the center section 12. In yet another embodiment, two rebars can be utilized, with each rebar being positioned in one of the areas 14, 16.

As shown in FIG. 1, the rebar positioning areas 14, 16 are substantially, but not completely, enclosed by the center section 12 of the positioner 10. A small gap exists to facilitate placement of the rebar 50 within the rebar positioning areas 14, 16. Alternatively, the center section 12 can have a substantially figure "8" shape that completely encloses the rebar positioning areas 14, 16.

The frictional engagement of the corners 46, 48 of the block core 42 with the arms 20, 30 resulting from the diagonal design of the positioner 10 yields excellent stability that aids in maintaining the rebar 50 at the desired position. In addition, the center section 12 being positioned within the block core 40, below the top surface 44 of the core 40, further contributes to the ability of the positioner 10 to remain in place on the block 40.

Figure 5:
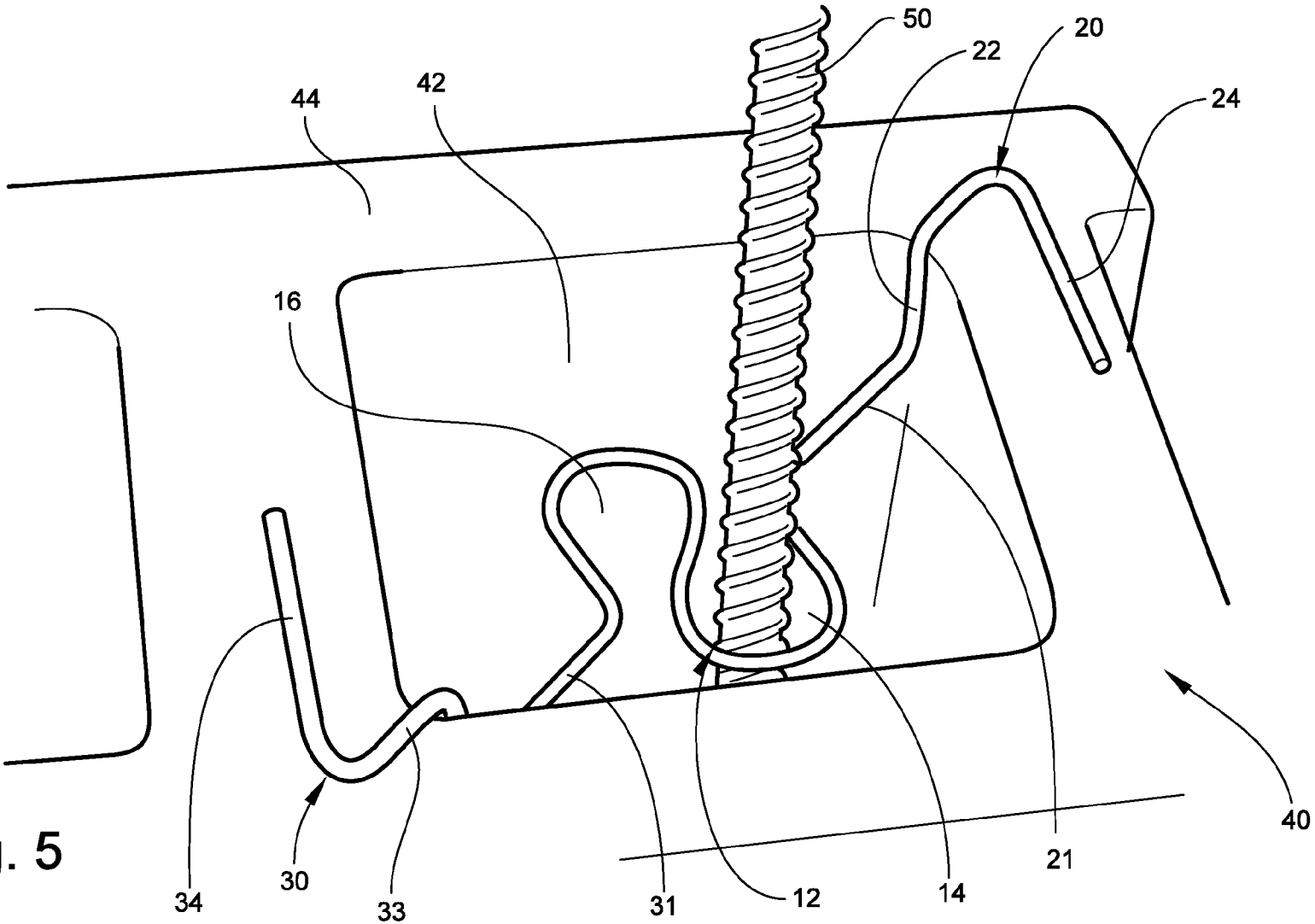
FIG. 5 is another environmental perspective view of the rebar positioner of FIG. 1.

FIG. 5 illustrates the rebar positioner 10 in an alternative position on the block 40. In this position, the bed joints on top of the block 40 can be free and clear, and the joint reinforcing and mortar can be applied without the rebar positioner 10 interfering.

A rebar positioner according to another preferred embodiment of the invention is illustrated in FIGS. 6-10, and shown generally at reference numeral 100. The rebar 100 is similar to the previously described rebar positioner 10, with the exception of the center section 112, which is comprised of two generally reverse "S" shaped sections that define four substantially enclosed rebar positioning areas 114, 115, 116, 117. Each end of the center section 112 leads to opposed two arms 120, 130 on opposite sides of the center section 112.

Figure 6:
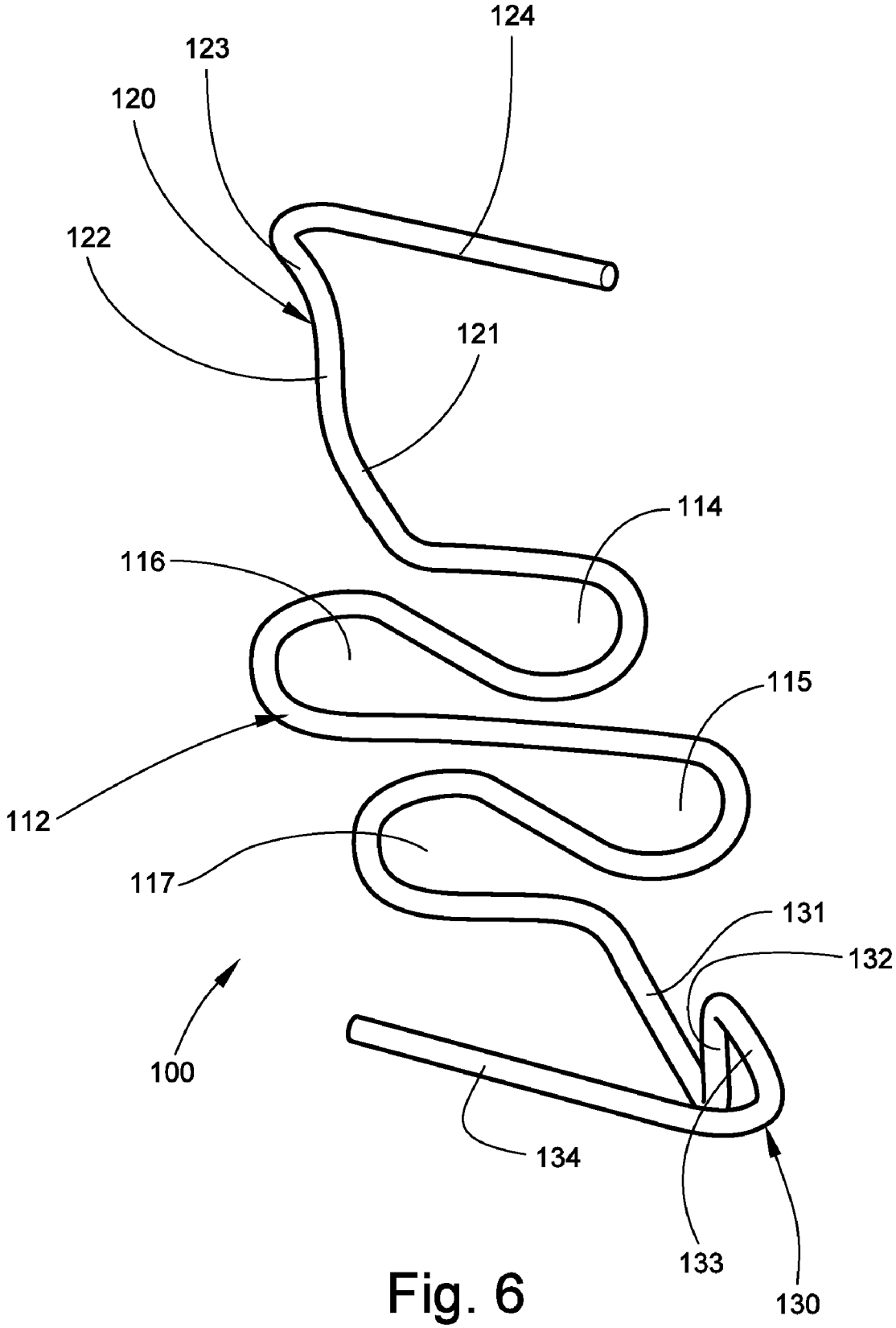
FIG. 6 is a perspective view of a rebar positioner according to another preferred embodiment of the invention.

The arms 120, 130 have substantially straight first segments 121, 131, respectively, that extend in substantially opposite directions from the center section 112 and lie on substantially the same plane as the center section 112. The first segments 121, 131 lead to second segments 122, 132, respectively, that extend substantially upwardly from the first segments 121, 131, respectively. The second segments 122, 132 are substantially perpendicular to the first segments 121, 131. Top ends of the second segments 122, 132 lead to third segments 123, 133, respectively, that are substantially perpendicular to the second segments 122, 132, and extend in opposite directions away from the center section 112. Fourth segments 124, 134 extend from the third segments 123, 133, respectively, at acute angles, such as at forty-five degrees. As shown in FIG. 6, the fourth segments 124, 134 extend in opposite directions relative to the center axis of the positioner 100. That is, for example, one of the fourth segments 124 extends to the right of the first, second and third segments 121, 122, 123, 131, 132, 133, while the other fourth segment 134 extends to the left of the first, second and third segments 121, 122, 123, 131, 132, 133. Alternatively, the orientation could be reversed with one fourth segment 124 extending to the left of the first, second and third segments 121, 122, 123, 131, 132, 133, while the other fourth segment 134 extends to the right.

Figure 7:
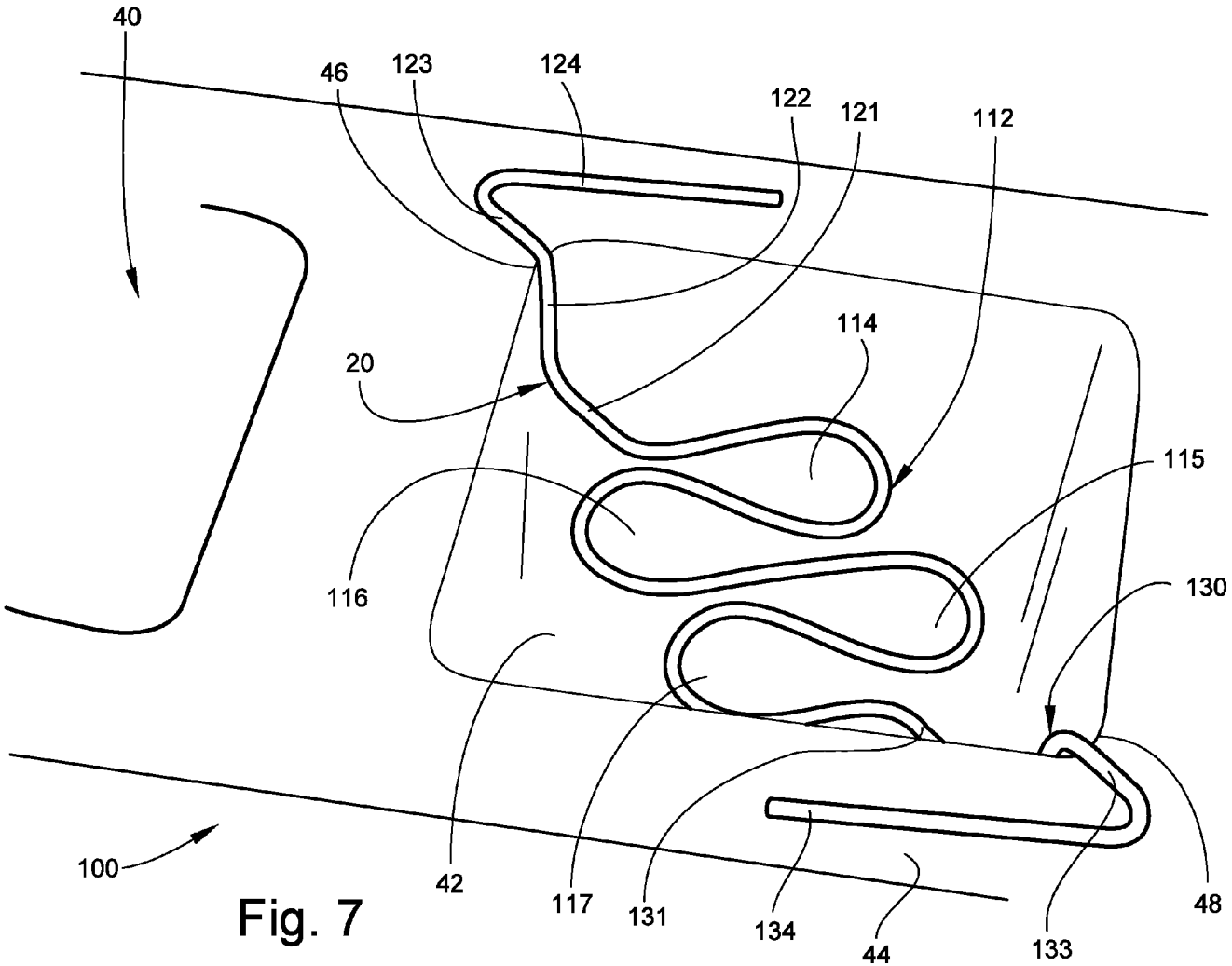
FIG. 7 is an environmental perspective view of the rebar positioner of FIG. 6, shown positioned within the core of a masonry block.

As shown in FIG. 7, the positioner 100 is positioned within a substantially square core 42 of a rectangular masonry block 40. The masonry block 40 can be made of concrete, brick, stone or other suitable masonry material. The positioner 100 is positioned on the masonry block 40 with the third segments 123, 133 and fourth segments 124, 134 lying on the top surface 44 of the block 40. The positioner 10 is positioned within the block core 42 diagonally, such that the second and third segments 122, 123 of one arm 120 are positioned at one corner 46 of the block core 42, while the second and third segments 132, 133 of the other arm 130 are positioned at an opposite diagonal corner 48 of the block core 42. As such, the corners 46, 48 restrict movement of the arms 120, 130, and prevent the positioner 100 from sliding from the desired position. In addition, the opposed symmetrical arrangement of the fourth segments 124, 134 of the arms 120, 130 further contributes to the stability of the positioner. Furthermore, the counter balanced arrangement of the four loops of the center section 112 defining the four substantially enclosed rebar positioning areas 114-117 also aids in maintaining the positioner 100 in its desired position.

Because the second segments 122, 132 of the arms 20, 30 extend substantially perpendicularly and upwardly from the first segments 121, 131, the center section 112 resides in a plane below that of the third segments 123, 133 and fourth segments 124, 134, which rest on the top surface 44 of the block 40. As such, the center section 112 resides below the top surface 44 of the block 40 and inside the block core 42, as shown in FIG. 7.

Figure 8:
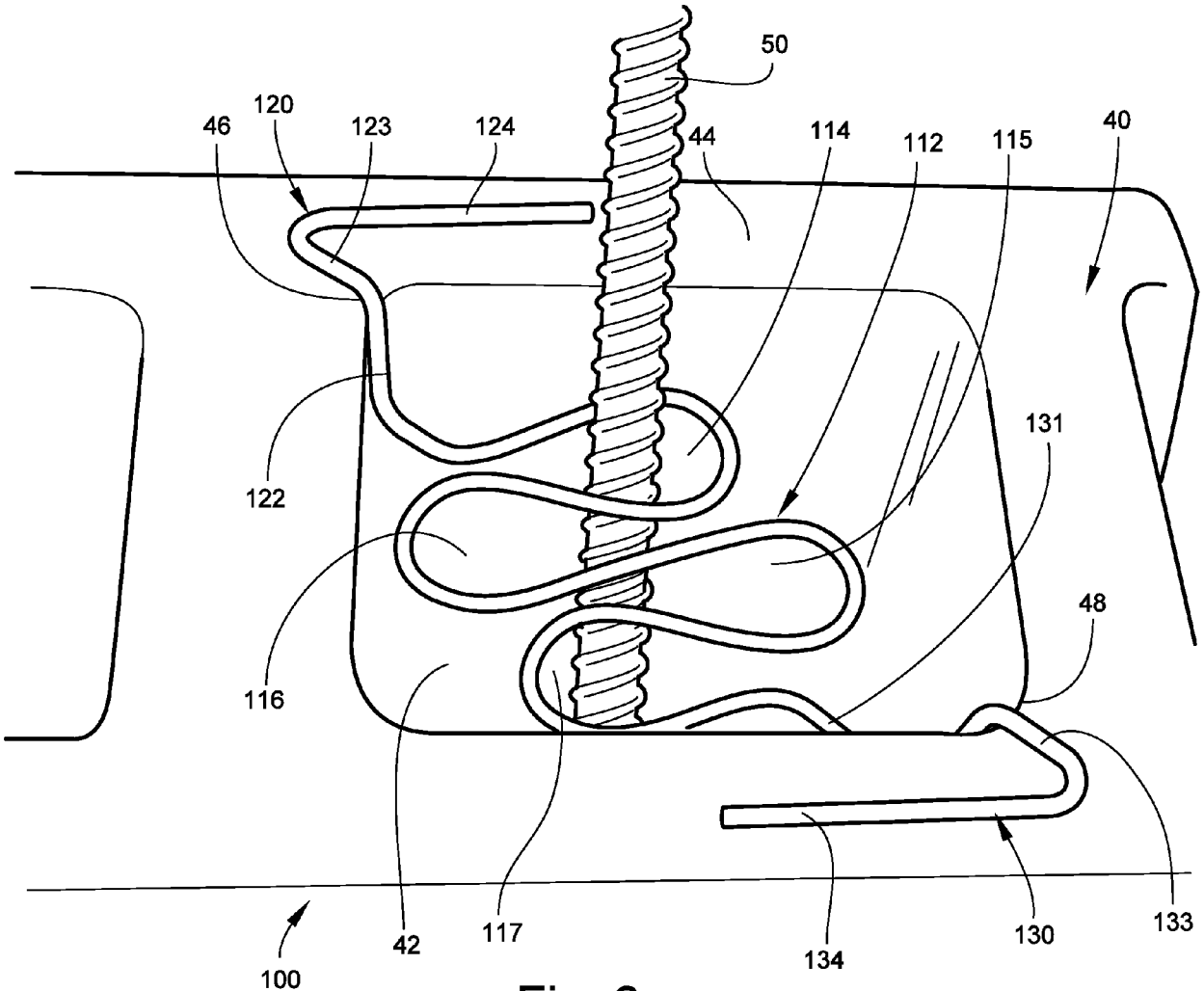
FIG. 8 is an environmental perspective view of the rebar positioner of FIG. 6, shown being used in conjunction with a rebar.
Figure 9:
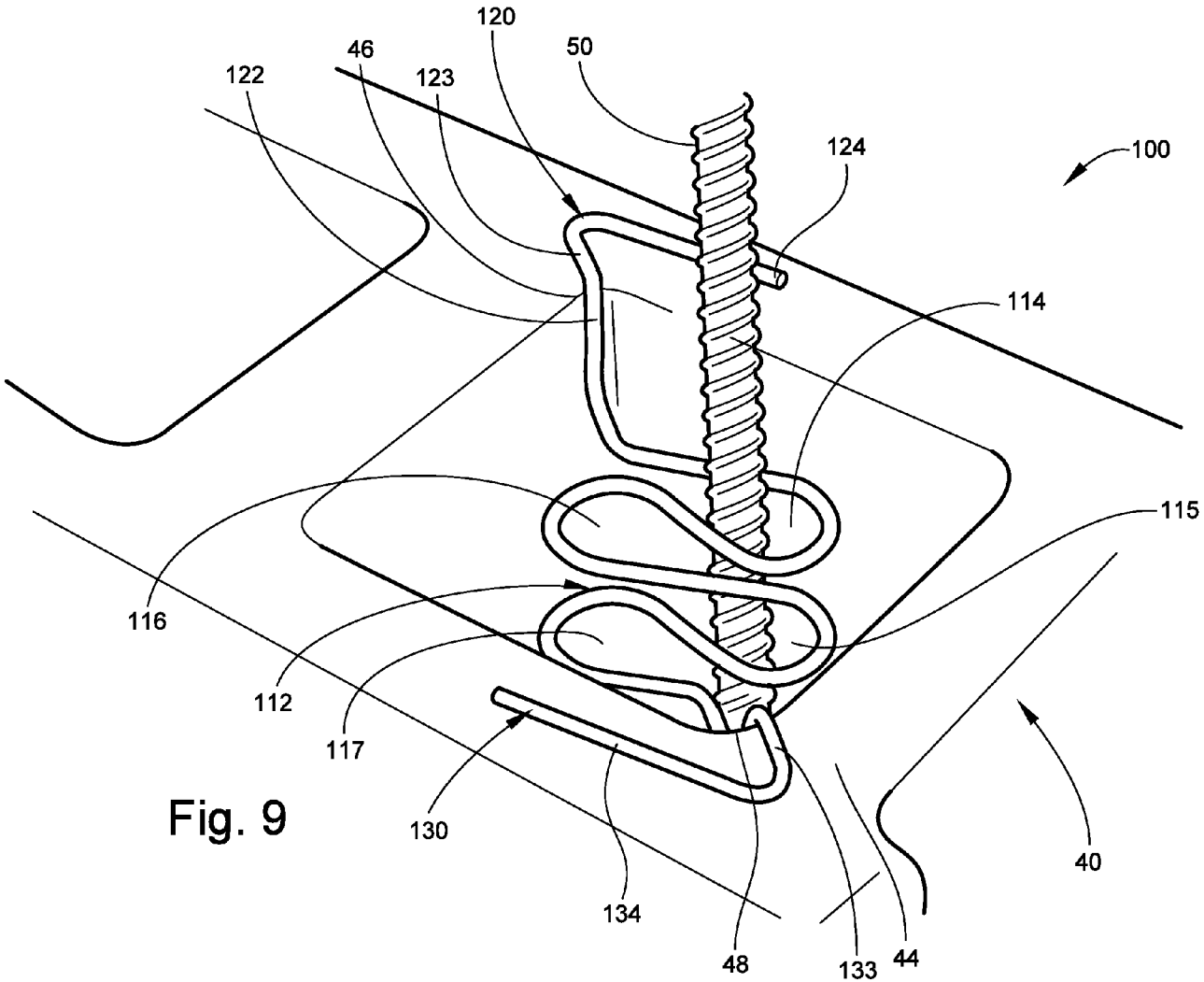
FIG. 9 is another environmental perspective view of the rebar positioner of FIG. 6.

As shown in FIGS. 8 and 9, the rebar 50 can be positioned within any one of the rebar positioning areas 114-117 of the center section 112, such as area 114, in order to help maintain the rebar 50 at a approximately the center of the block core 42 while grout, concrete or other desired hardening fill material is poured into the block core 42. Maintaining the rebar 50 at approximately the center of the block core 42 maximizes the strength and stability provided by the rebar 50 to the masonry structure. It is to be noted that up to four rebars can be utilized simultaneously with positioner 100. For example, two rebars can positioned in rebar positioning areas 114 and 116 at the same time.

As shown in FIG. 6, the rebar positioning areas 114-117 are substantially enclosed by the center section 112 of the positioner 100, with a small gap existing to facilitate placement of the rebar 50 within the rebar positioning areas 114-117.

The frictional engagement of the corners 46, 48 of the block core 42 with the arms 120, 130 resulting from the diagonal design of the positioner 100 yields excellent stability that aids in maintaining the rebar 50 at the desired position. In addition, the center section 112 being positioned within the block core 40 further contributes to the ability of the positioner 10 to remain in place on the block 40.

Figure 10:
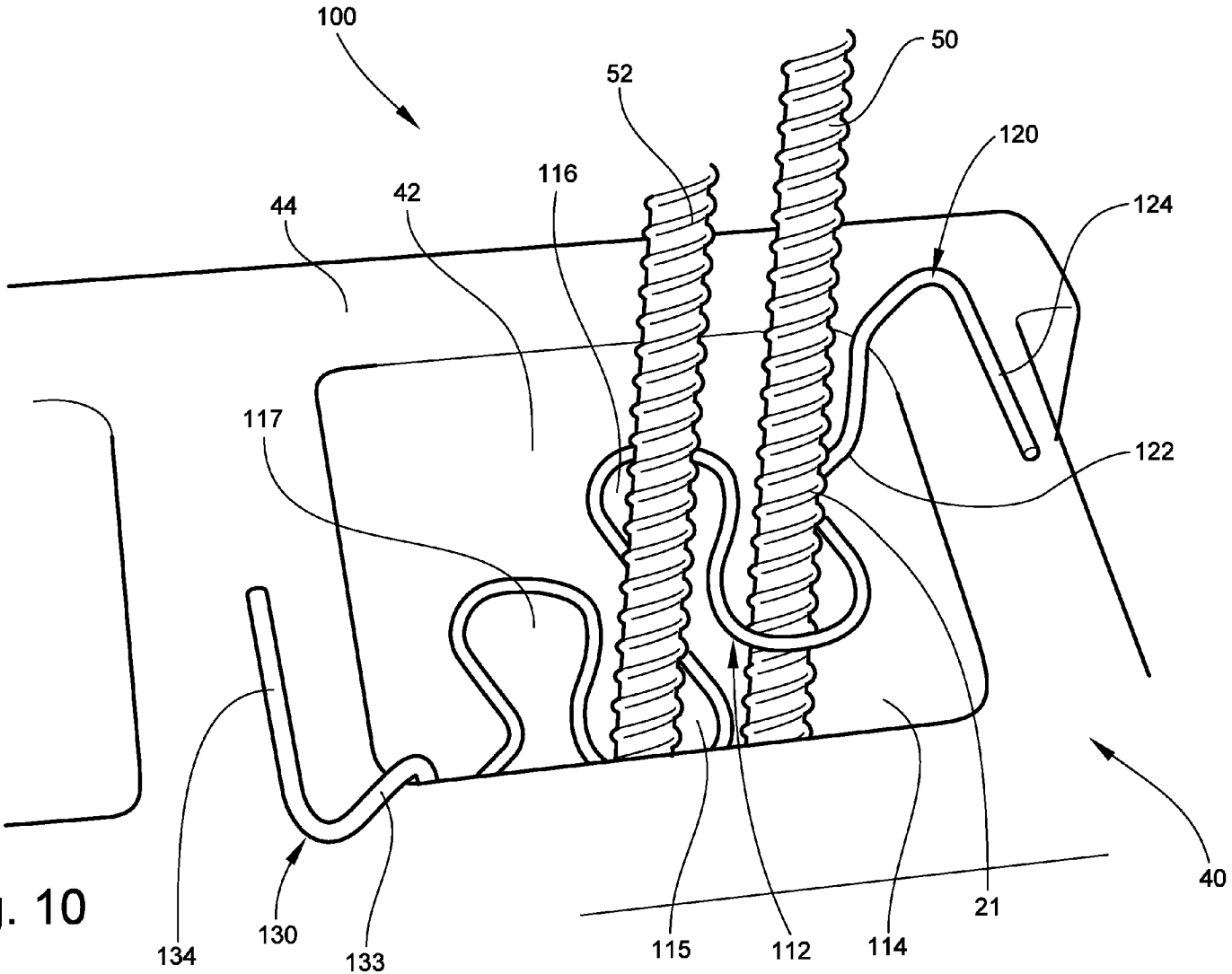
FIG. 10 is another environmental perspective view of the rebar positioner of FIG. 6.

FIG. 10 illustrates the rebar positioner 10 in an alternative position on the block 40. In this position, the bed joints on top of the block 40 can be free and clear, and the joint reinforcing and mortar can be applied without the rebar positioner 100 interfering.

A rebar positioner according to yet another preferred embodiment of the invention is illustrated in FIGS. 11-15, and shown generally at reference numeral 200. The rebar positioner 200 is similar to the previously described embodiments, with the exception of a center section 212 comprising a fully enclosed circular loop that defines a single rebar positioning area 214.

Figure 11:
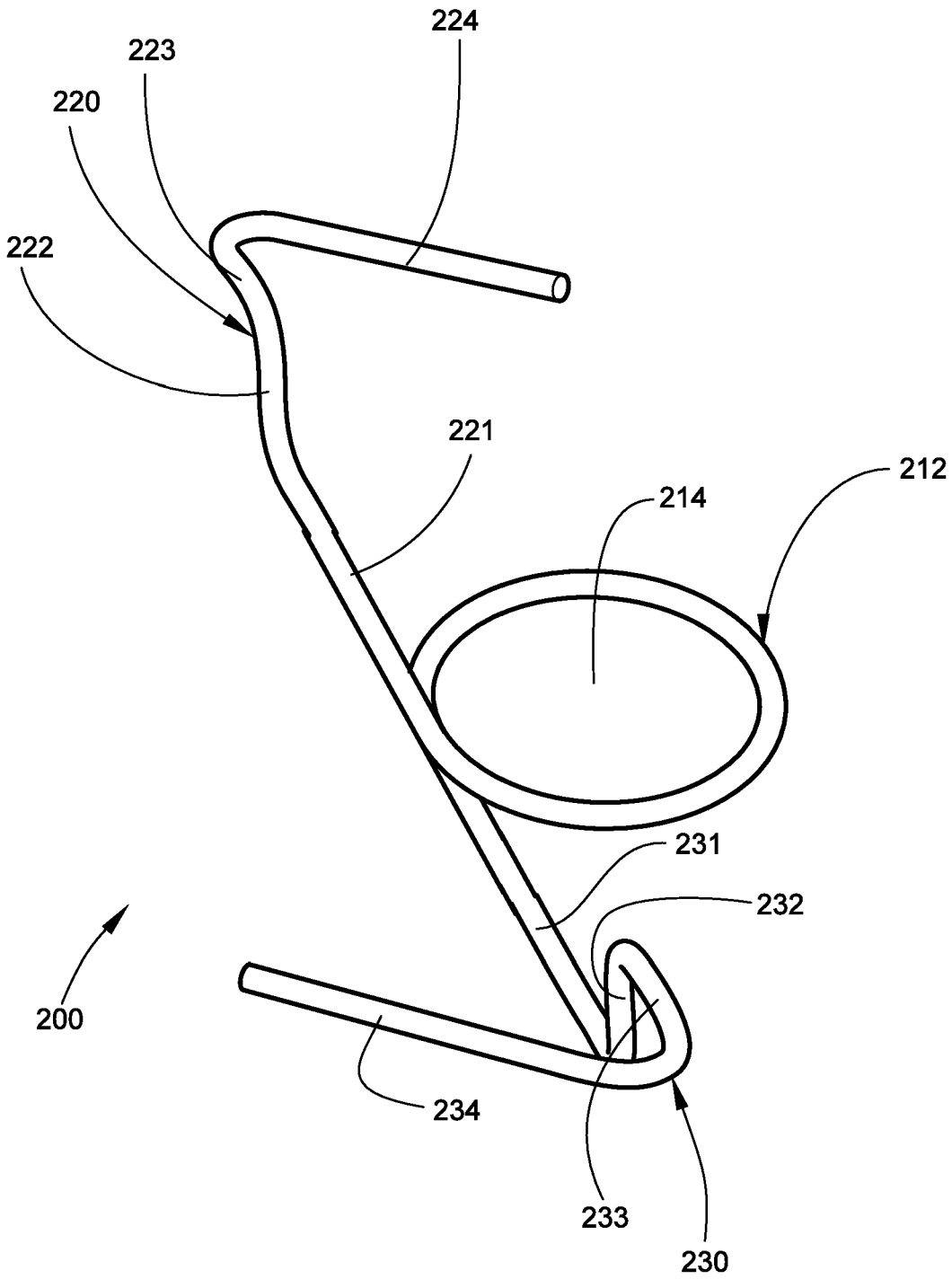
FIG. 11 is a perspective view of a rebar positioner according to a preferred embodiment of the invention.

As shown in FIG. 11, two arms 220, 230 extend in opposite directions from the center section 212. The arms 220, 230 have substantially straight first segments 221, 231 leading to second segments 222, 232, respectively. The second segments 222, 232 extend substantially upwardly from the first segments 221, 231, respectively. The second segments 222, 232 are substantially perpendicular to the first segments 221, 231. Top ends of the second segments 222, 232 lead to third segments 223, 233, respectively, that are substantially perpendicular to the second segments 222, 232, and extend in opposite directions away from the center section 212. Fourth segments 224, 234 extend from the third segments 223, 233, respectively, at acute angles, preferably forty-five degrees. As shown in FIG. 11, the fourth segments 224, 234 extend in opposite directions relative to the positioner 200. That is, for example, one of the fourth segments 224 extends to the right of the first, second and third segments 221, 222, 223, 231, 232, 233, while the other fourth segment 234 extends to the left of the first, second and third segments 221, 222, 223, 231, 232, 233. Alternatively, the orientation could be reversed with one fourth segment 224 extending to the left of the first, second and third segments 221, 222, 223, 231, 232, 233, while the other fourth segment 234 extends to the right.

Figure 12:
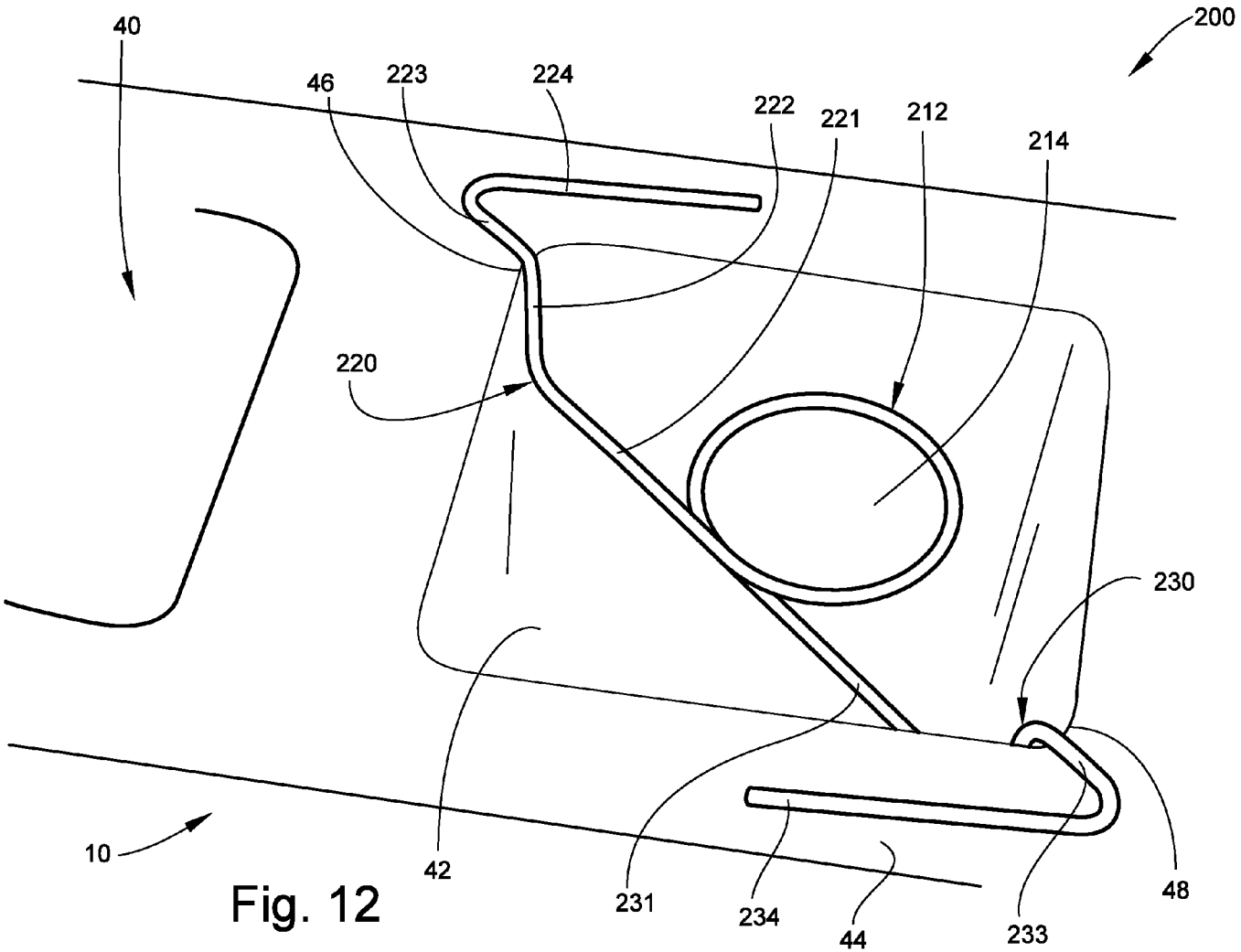
FIG. 12 is an environmental perspective view of the rebar positioner of FIG. 11, shown positioned within the core of a masonry block.

As shown in FIG. 12, the positioner 200 is positioned within the substantially square core 42 of the rectangular masonry block 40. The positioner 200 is positioned on the masonry block 40 with the third segments 223, 233 and fourth segments 224, 234 lying on the top surface 44 of the block 40. The positioner 200 is positioned within the block core 42 diagonally, such that the second and third segments 222, 223 of one arm 220 are positioned at one corner 46 of the block core 42, while the second and third segments 232, 233 of the other arm 230 are positioned at an opposite diagonal corner 48 of the block core 42. As such, the corners 46, 48 restrict movement of the arms 220, 230, and prevent the positioner 200 from sliding from the desired position. In addition, the opposed symmetrical arrangement of the fourth segments 224, 234 of the arms 220, 230 further contributes to the stability of the positioner.

Because the second segments 222, 232 of the arms 220, 230 extend substantially perpendicularly from the first segments 221, 231, the center section 212 resides in a plane below that of the third segments 223, 233 and fourth segments 224, 234, which lie on top of the block 40. As such, the center section 212 resides below the top surface 44 of the block 40 and inside the block core 42, as shown in FIG. 12.

Figure 13:
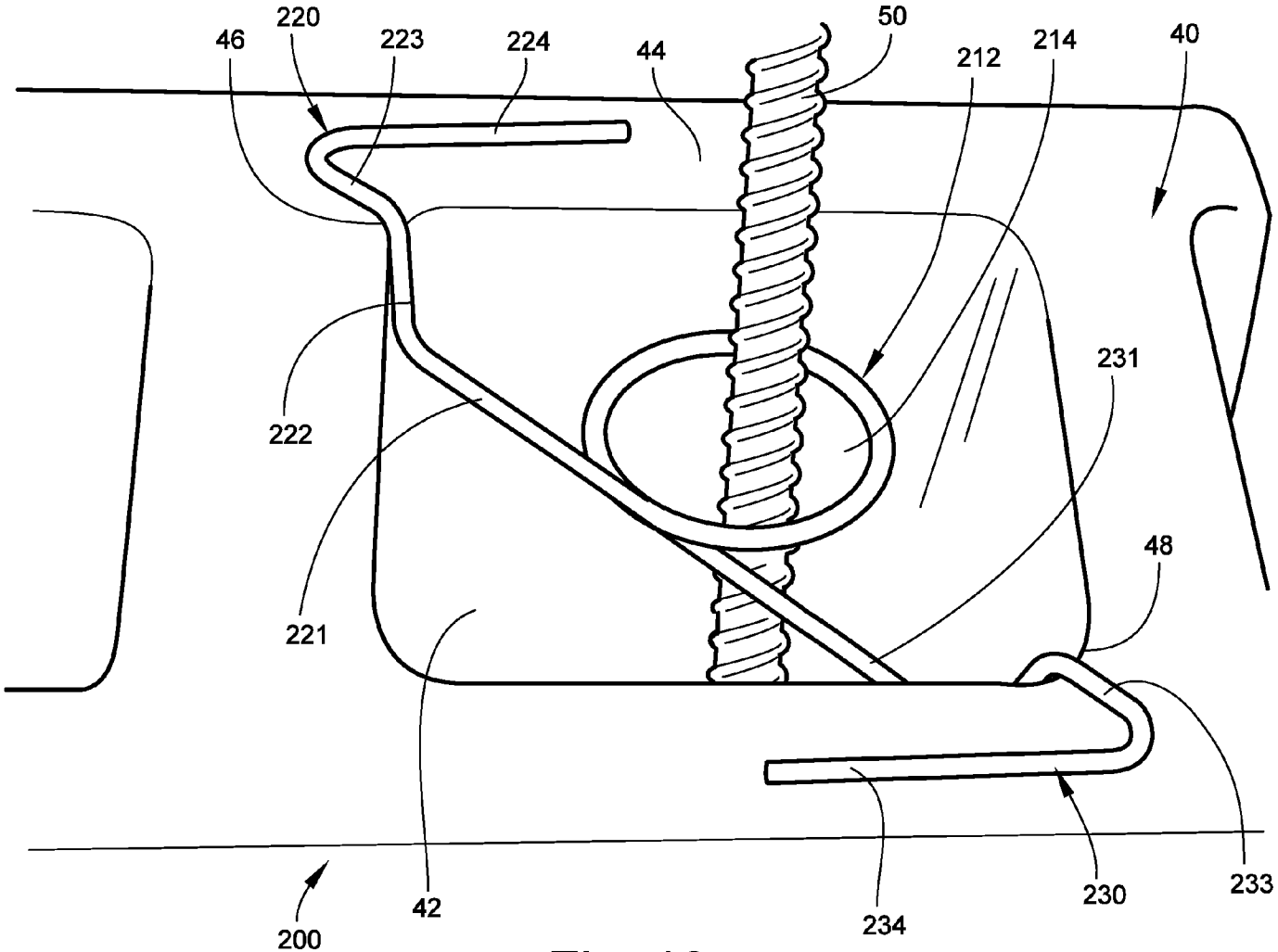
FIG. 13 is an environmental perspective view of the rebar positioner of FIG. 11, shown being used in conjunction with a rebar.
Figure 14:
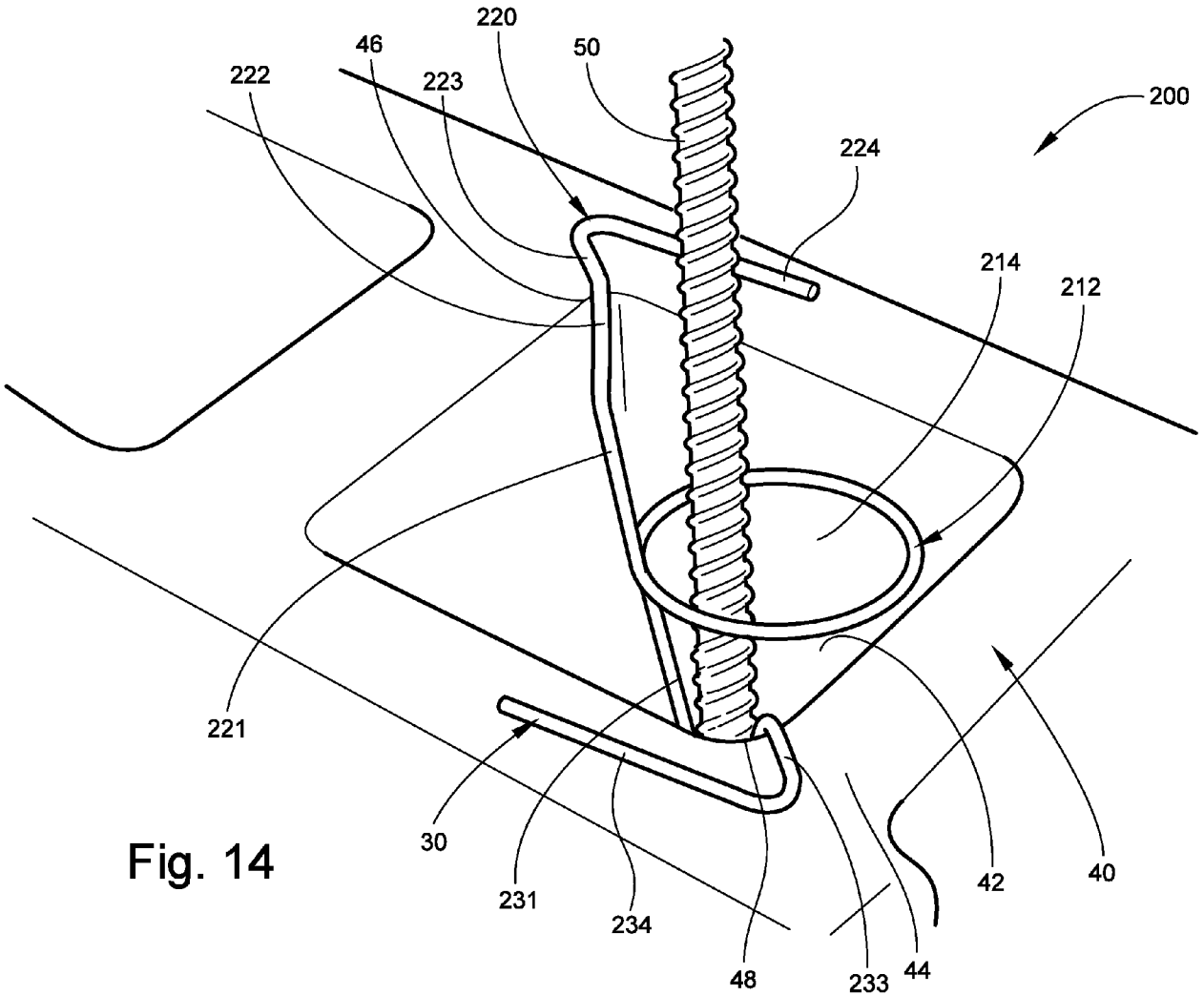
FIG. 14 is another environmental perspective view of the rebar positioner of FIG. 11.

As shown in FIGS. 13 and 14, the rebar 50 is positioned within the rebar positioning area 214 of the center section 212. This maintains the rebar 50 at approximately the center of the block core 42 while grout, concrete or other desired hardening fill material can be poured into the block core 42.

The frictional engagement of the corners 46, 48 of the block core 42 with the arms 220, 230 resulting from the diagonal design of the positioner 200 yields excellent stability that aids in maintaining the rebar 50 at the desired position. In addition, the center section 212 being positioned within the block core 40, below the top surface 44 of the core, further contributes to the ability of the positioner 200 to remain in place on the block 40.

Figure 15:
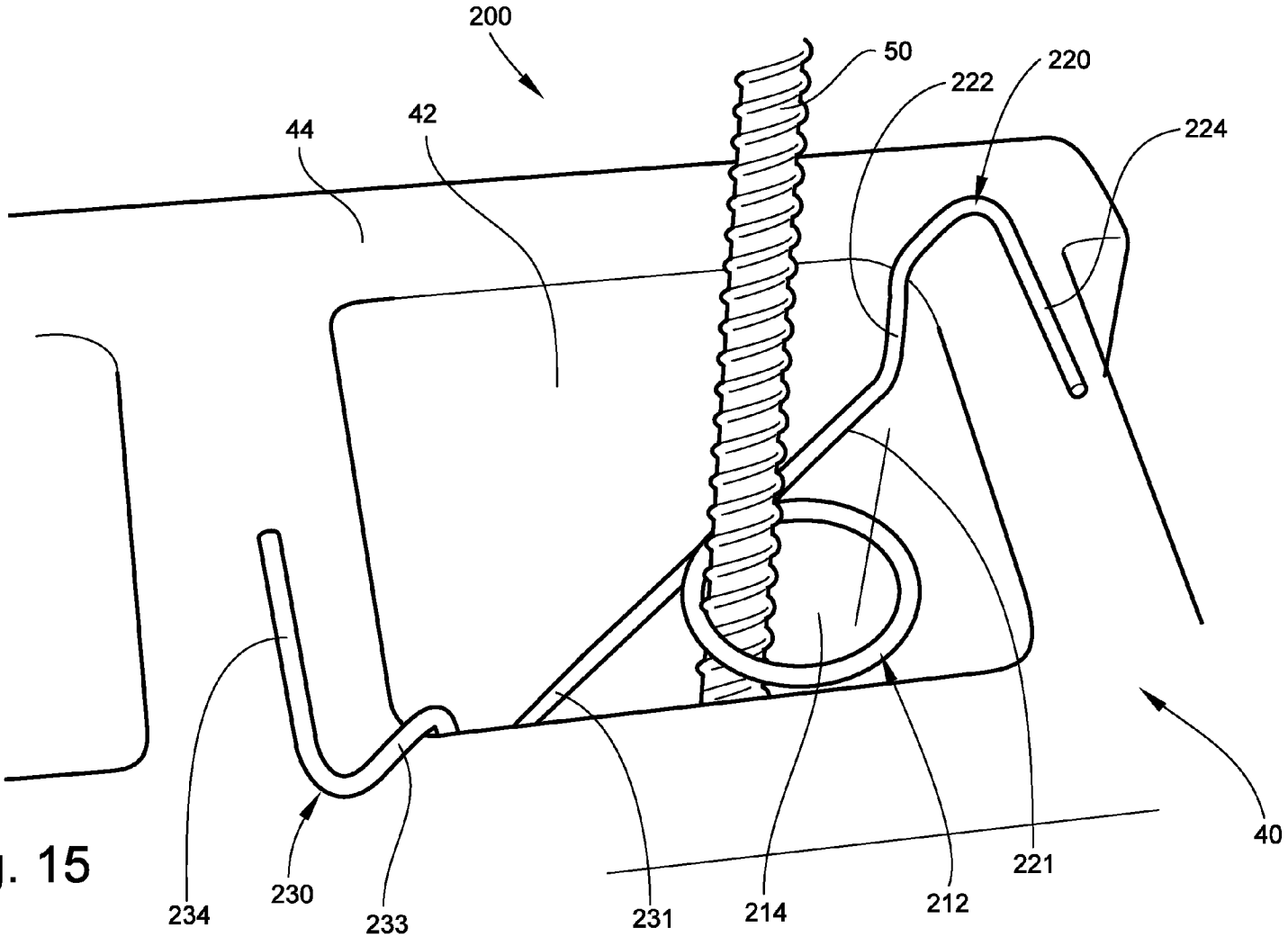
FIG. 15 is another environmental perspective view of the rebar positioner of FIG. 11.

FIG. 15 illustrates the rebar positioner 200 in an alternative position on the block 40. In this position, the bed joints on top of the block 40 can be free and clear, and the joint reinforcing and mortar can be applied without the rebar positioner 200 interfering.

Referring to FIGS. 16-20, a rebar positioner in accordance with another embodiment of the invention is shown generally at reference numeral 300. It should be understood that the disclosure and description provided herein with respect to the embodiment shown in FIGS. 16-20 can be used to further define the geometry of the embodiments shown in the previous figures, with the exception of the telltale or "safety". Rebar positioner 300 is configured for installation in a diagonal orientation within a generally rectangular cell of a masonry block, such as a concrete block, and includes a physical indicator, i.e. "telltale", for ensuring correct positioner installation and consequentially rebar alignment within the cell, as described in detail below.

Rebar positioner 300 generally includes a single, continuous wire 302 bent to define first and second end sections 304, 306 oriented coplanar and in a first plane, center section 308 having a general S-shape oriented in a second plane parallel to the first plane, laterally offset first and second linear sections 310, 312 extending in opposing directions from the center section 308 and oriented in the second plane, and first and second connecting sections 314, 316 interconnecting the first and second end sections 304, 306 with the first and second linear sections 314, 316, respectively, and oriented parallel to one other and perpendicular to the first and second planes.

Figure 18:
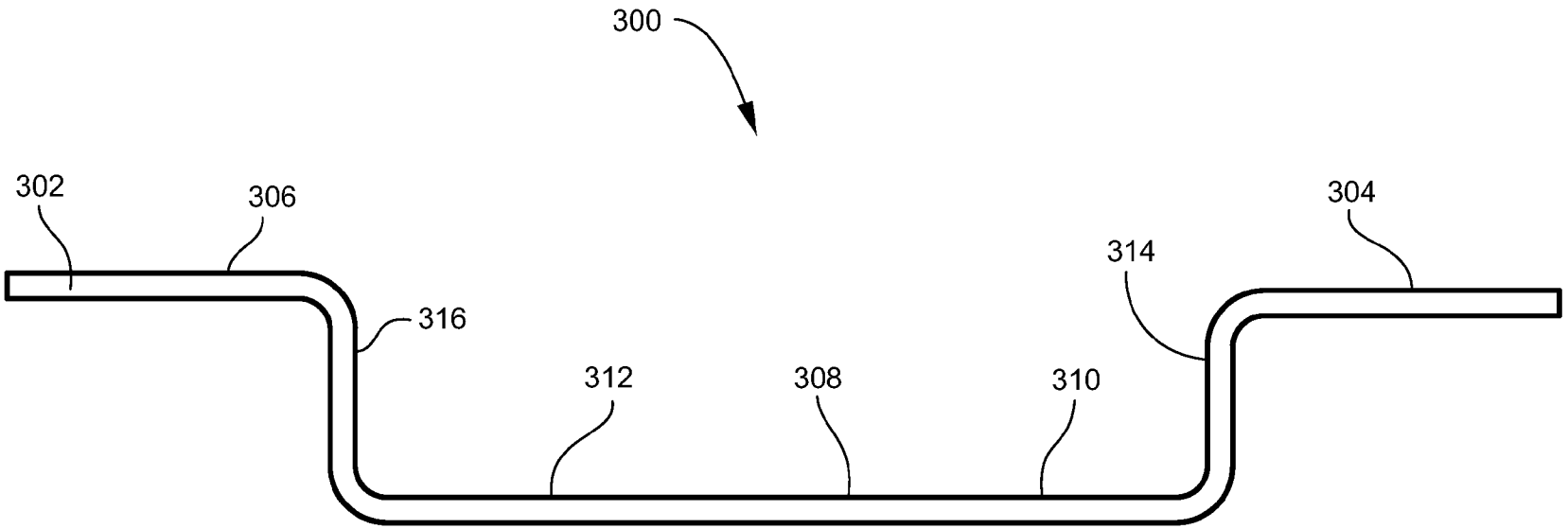
FIG. 18 is a side elevation view of the rebar positioner of FIG. 16.

First end section 304 is supported on the surface of the associated block about one end thereof and terminates in first linear portion 318 oriented at about a 45 degree angle toward and with respect to first linear section 310, as illustrated in FIG. 18. It is intended that the angle of first linear portion 318 with respect to first linear section 310 may vary from 45 degrees, so long as first linear portion 318 is generally supported at least in part on a surface of the block and does not extend laterally beyond the perimeter of the top surface of the block, i.e. past the sides.

Figure 17:
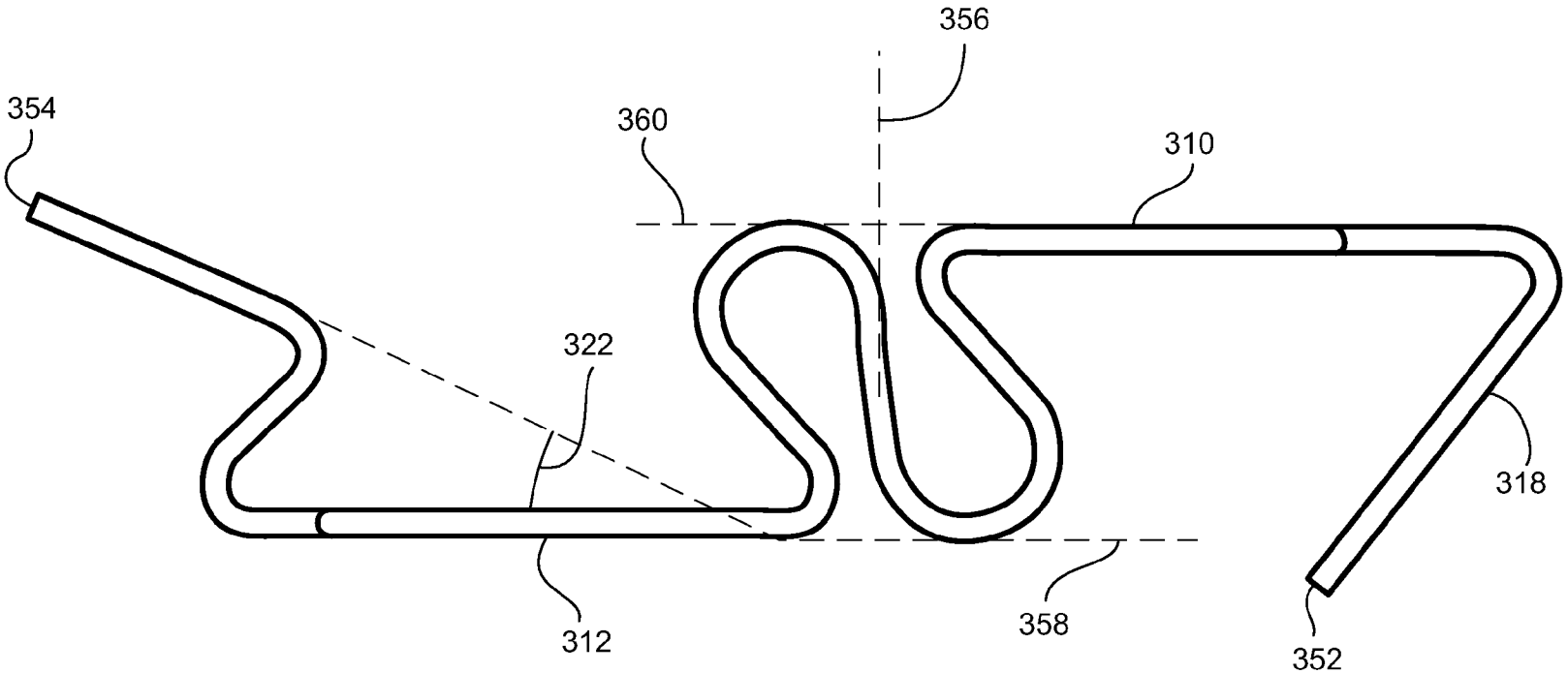
FIG. 17 is an overhead plan view of the rebar positioner of FIG. 16.
Figure 19:
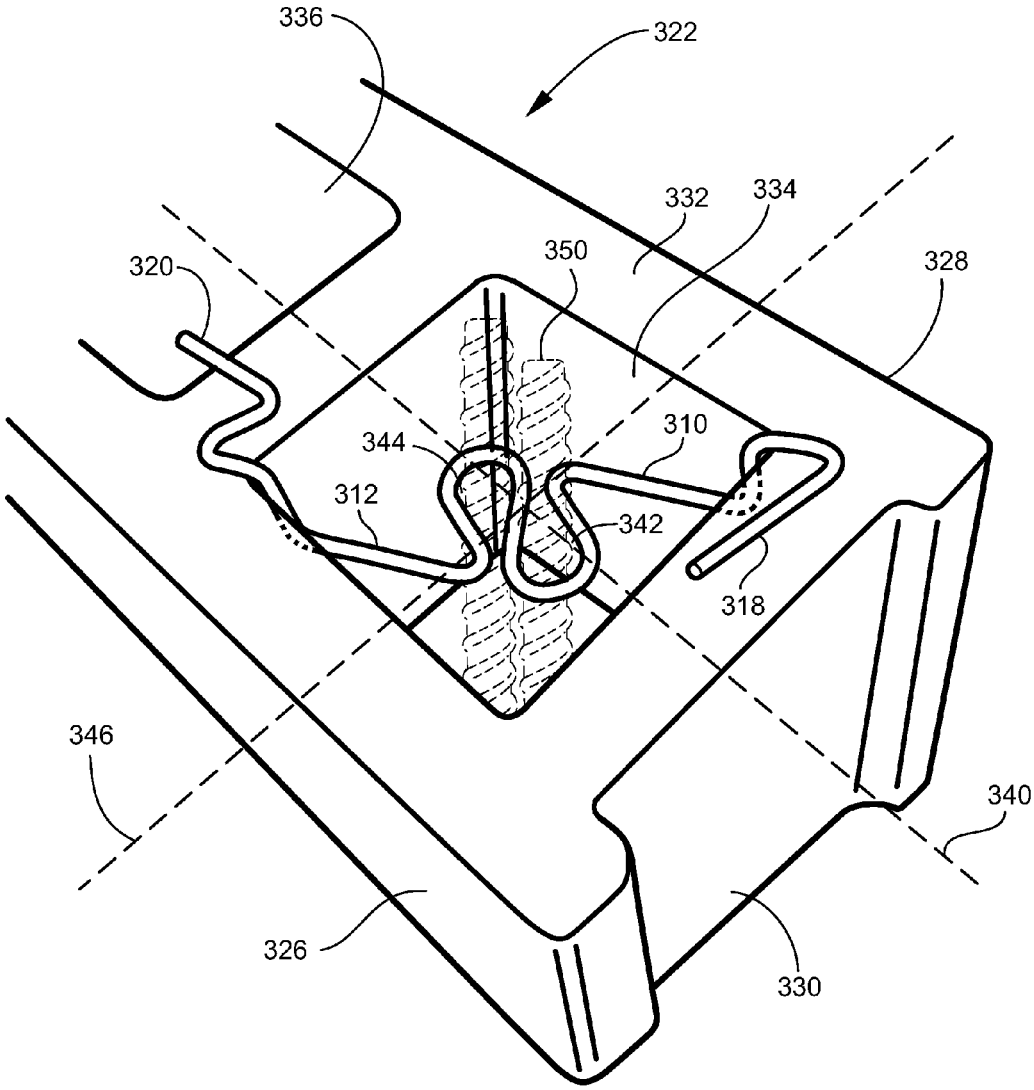
FIG. 19 is an environmental perspective view of the rebar positioner of FIG. 16 shown correctly installed within a cell of a concrete block.
Figure 20:
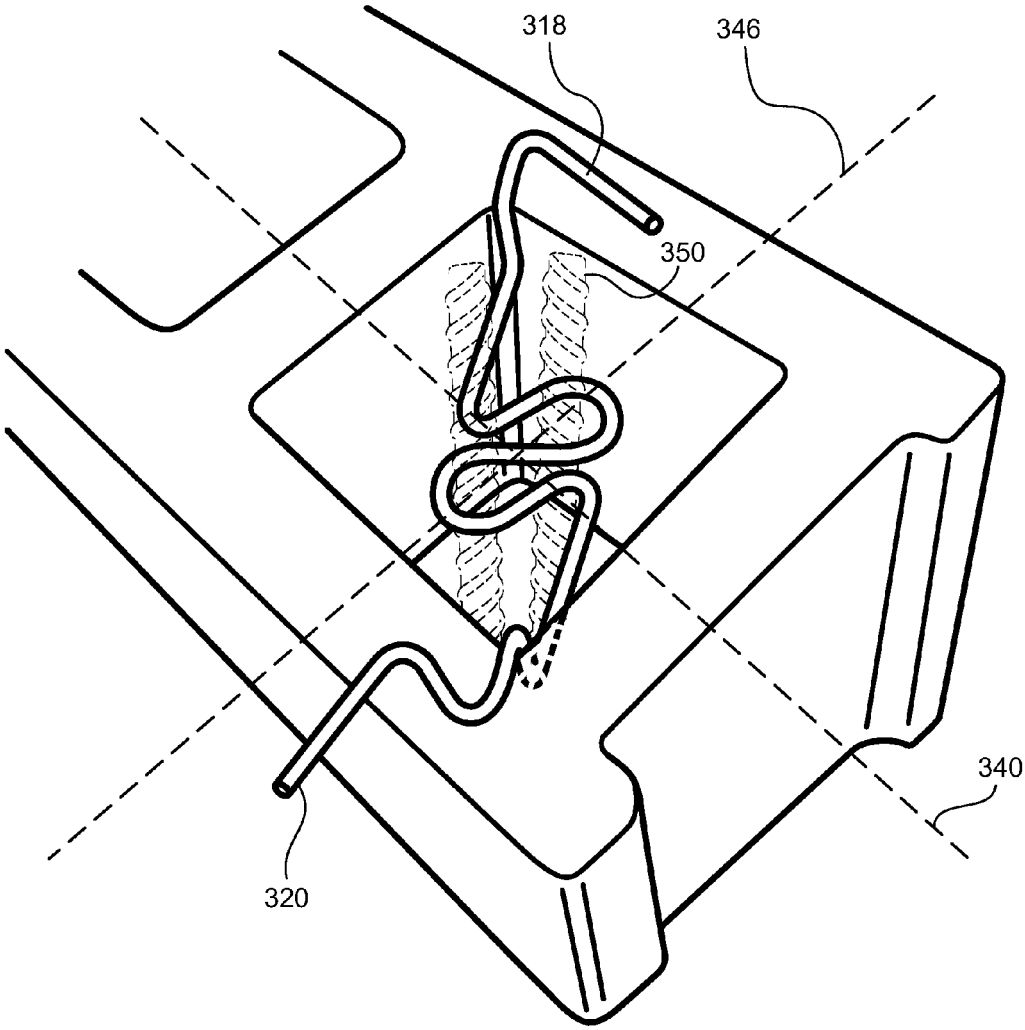
FIG. 20 is an environmental perspective view of the rebar positioner of FIG. 16 shown incorrectly installed within a cell of a concrete block.

Second end section 306 terminates in linear telltale 320, or "safety" that extends away from center section 308 as shown. As best shown in FIG. 17, telltale 320 is oriented at an acute angle with respect to second linear section 312. In a further embodiment, telltale 320 is oriented at about a 30 degree angle with respect to telltale 320, shown at angle 322. It is envisioned that telltale 320 may be oriented about parallel with respect to second linear section 312 while accomplishing its intended function of indicating correct installation. Specifically, telltale 320 is oriented and has a sufficient length such that telltale 320 is supported on the top surface of the associated block and extends over a portion of the opening to the adjacent cell, as best shown in FIG. 19. This extension beyond the surface of an internal wall and over a portion of an adjacent cell is sufficient such that when installed incorrectly, as shown in FIG. 20, telltale 320 extends laterally beyond the perimeter of the top surface of the associated block, i.e. beyond the wall. Thus, telltale 320 is a physical and visual indicator that ensures correct installation of positioner 300 within its respective cell, and consequentially the proper alignment of at least one reinforcing bar within the cell, as described in detail below.

Referring specifically to FIG. 19, rebar positioner 300 is shown correctly installed within a cell of a concrete block. Concrete block 324 generally includes sides 326, 328, 330, top surface 332, and at least one cell 334 open to top surface 332. In the specific block shown, block 324 includes adjacent cells 334, 336 separated by internal wall 338, with each cell having a generally rectangular cross section and four corners. Rebar positioner 300, when correctly installed, spans the length between opposing corners of cell 334 with first and second connecting sections 314, 316 seated in and parallel to a portion of the length of their respective corners. Center section 308 and first and second linear sections 310, 312, all lying in the second plane, are positioned apart from top surface 332 toward the interior of cell 334. First and second end sections 304, 306, lying in the first plane, seat upon and are parallel to surface 332 of block 324 such that they lie flush against the surface and do not interfere with the seating of an overlying block. As can be seen in FIG. 19, the angle of first linear portion 318 is such that it is fully supported on top surface 332.

When rebar positioner 300 is correctly positioned within cell 334, the openings defined by the S-shape of center section 308 define centers generally aligned along longitudinal axis 340 of block 324. Thus, reinforcing bars 350 maintained within openings 342, 344 are consequentially aligned in a generally vertical orientation along longitudinal axis 340. Should rebar positioner 300 be incorrectly installed within cell 334, such as shown in FIG. 20, openings 342, 344 are aligned along lateral axis 346 of block 324, and reinforcing bars 350 maintained within openings 342, 344 are consequentialy misaligned in a generally vertical orientation along lateral axis 346.

Figure 16:
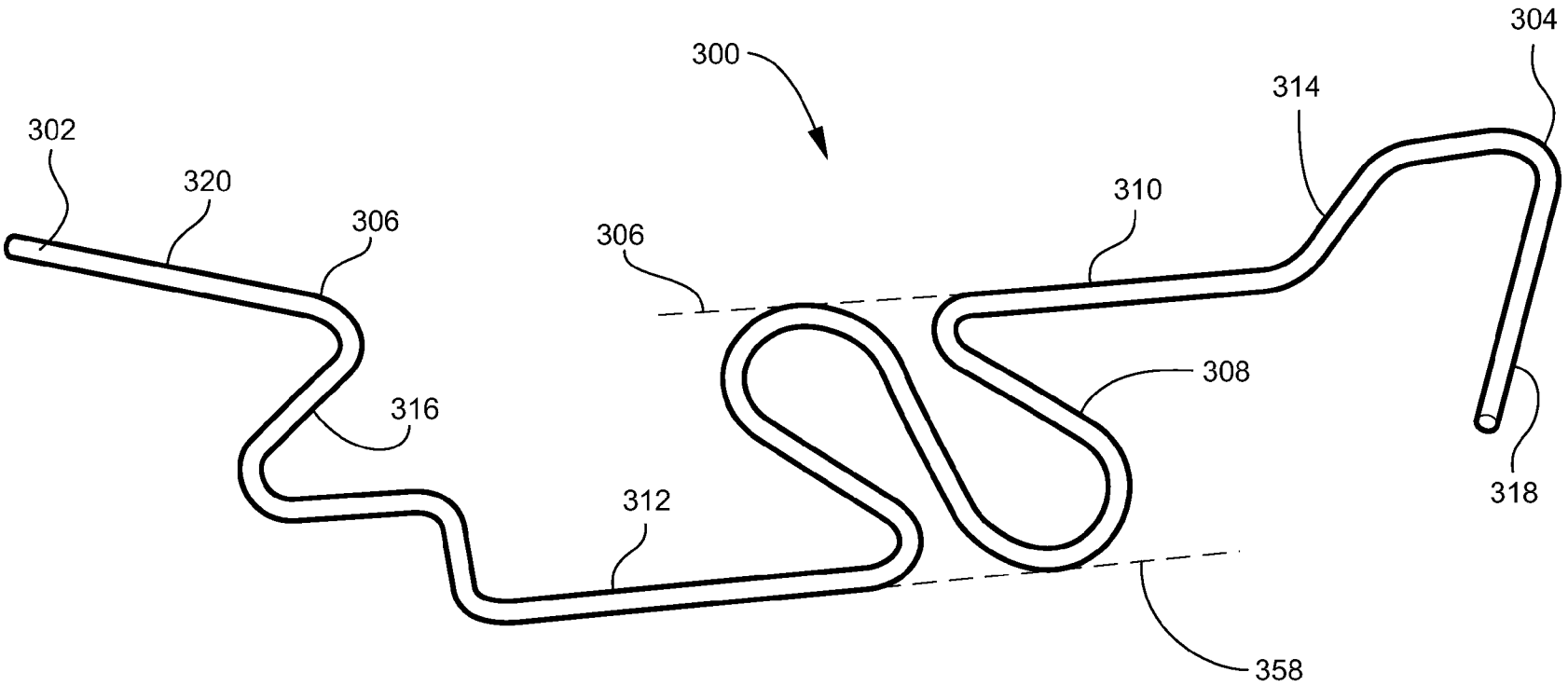
FIG. 16 is a perspective view of another embodiment of a rebar positioner including a telltale.

Referring specifically to FIGS. 16 and 17, further geometric features of rebar positioner 300 include end 352 of first linear portion 318 is generally perpendicular to end 354 of telltale 320, opposing loops of center section 308 define centers laterally offset with respect to centerline 356 of positioner 300, center section 308 does not extend laterally beyond axes 358, 360 of first and second linear sections 310, 312, respectively, and the wire has a generally circular cross-section.

In accordance with another embodiment of the invention, a method of installing rebar positioner 300 within a cell of a concrete block is providing including the steps of: (i) providing a concrete block 324 having sides 326, 328, 330, top surface 332, and cell 334 open to top surface 332; (ii) providing a rebar positioner 300 comprising a single, continuous wire bent to define first and second end sections 304, 306 oriented coplanar and in a first plane, a center section 308 having a general S-shape oriented in a second plane parallel to the first plane, laterally offset first and second linear sections 310, 312 extending in opposing directions from center section 308 and oriented in the second plane, and first and second connecting sections 314, 316 interconnecting the first and second end sections 304, 306 with the first and second linear sections 310, 312, respectively, and oriented parallel to each other and perpendicular to the first and second planes, wherein the second end section 306 terminates in a linear telltale 320 extending away from center section 308; and (iii) positioning rebar positioner 300 diagonally within the cell 334 and spanning a distance between opposing corners thereof such that center section 308 and laterally offset first and second linear sections 310, 312 are positioned within an interior of cell 334 spaced-apart from top surface 332, and with first and second ends 304, 306 seated on top surface 332 of block 324 and not extending laterally beyond sides 326, 328, 330 of block 324.

Various embodiments of rebar positioners and methods for positioning said positioners within a cell of a masonry block have been provided herein. It is envisioned that modifications can be made to the positioners to accommodate masonry blocks of varying shapes, sizes, etc. without departing from the scope of the invention. Furthermore, the foregoing description of the preferred embodiments of the invention and the best mode for practicing the invention are provided for the purpose of illustration only and not for the purpose of limitation.

What is claimed is:

1. A rebar positioner configured for being placed in a diagonal orientation within a cell of a masonry block, comprising:

a single, continuous wire bent to define first and second end sections oriented coplanar in a first plane, a center section having a general S-shape oriented in a second plane parallel to the first plane, laterally offset first and second linear sections extending in opposing directions from the center section and oriented in the second plane, and first and second connecting sections interconnecting the first and second end sections with the first and second linear sections, respectively, and oriented parallel to each other and perpendicular to the first and second planes;

wherein the second end section terminates in a linear telltale extending away from the center section, and the linear telltale is oriented at about a 30 degree angle relative to the second linear section.

2. The rebar positioner according to claim 1, wherein the linear telltale is oriented at an acute angle with respect to the second linear section.

3. The rebar positioner according to claim 1, wherein the first end section terminates in a first linear portion oriented at about a 45 degree angle toward and with respect to the first linear section.

4. The rebar positioner according to claim 1, wherein free ends of the first linear section and the linear telltale face in generally perpendicular directions.

5. The rebar positioner according to claim 1, wherein opposing loops of the center section define centers laterally offset with respect to a centerline of the positioner.

6. The rebar positioner according to claim 1, wherein the center section does not extend laterally beyond axes of the first and second linear sections.

7. The rebar positioner according to claim 1, wherein each of the first and second end sections further comprise subsections oriented parallel to and in-line with their respective first and second linear sections.

8. The rebar positioner according to claim 1, wherein the wire has a generally circular cross-section.

9. The rebar positioner according to claim 1, wherein the positioner is positioned within the cell such that the first and second end sections do not extend laterally beyond sides of the block and the telltale extends over a portion of an adjacent cell of the masonry block.

* * * * *